US010934089B2

(12) United States Patent
Mullins

(10) Patent No.: US 10,934,089 B2
(45) Date of Patent: Mar. 2, 2021

(54) APPARATUS AND SYSTEM FOR BOTTOMLESS WASTE DISPOSAL BAG

(71) Applicant: Dylan Mullins, Goose Creek, SC (US)

(72) Inventor: Dylan Mullins, Goose Creek, SC (US)

( * ) Notice: Subject to any disclaimer, the term of this patent is extended or adjusted under 35 U.S.C. 154(b) by 0 days.

(21) Appl. No.: 16/434,311

(22) Filed: Jun. 7, 2019

(65) Prior Publication Data

US 2020/0130928 A1 Apr. 30, 2020

Related U.S. Application Data

(60) Provisional application No. 62/752,795, filed on Oct. 30, 2018.

(51) Int. Cl.
*B65F 1/00* (2006.01)
*B65F 1/14* (2006.01)
*B65D 88/16* (2006.01)

(52) U.S. Cl.
CPC ..... *B65F 1/0006* (2013.01); *B65F 1/1452* (2013.01); *B65D 88/1668* (2013.01); *B65F 2220/1063* (2013.01); *B65F 2250/1146* (2013.01)

(58) Field of Classification Search
CPC ..... B65F 1/0006; B65F 1/1452; B65F 2220/1063; B65F 2250/1146; B65D 88/1668
USPC ..... 383/67, 98, 6
See application file for complete search history.

(56) References Cited

U.S. PATENT DOCUMENTS 3,743,122 A * 7/1973 Fortriede ..... B65B 67/1227 414/392
3,827,471 A * 8/1974 Gregory ..... B65D 88/1612 222/181.3
3,893,595 A * 7/1975 Khanna ..... B65D 88/1668 222/181.3
5,072,798 A 12/1991 Franklin
5,072,828 A 12/1991 Irvine
5,340,218 A 8/1994 Cuthbertson
5,738,443 A * 4/1998 Renaud ..... B65D 88/1668 383/17

(Continued)

FOREIGN PATENT DOCUMENTS

FR 2564440 A1 * 11/1985 ..... B65D 88/1612
FR 2911124 A1 * 7/2008 ..... B65D 88/1668

(Continued)

*Primary Examiner* — Jes F Pascua
(74) *Attorney, Agent, or Firm* — Gregory Finch; Finch Paolino, LLC

(57) ABSTRACT

A reusable dumpster bag that can be rolled and unrolled for storage and setup, and is configured to be emptied via the bottom of the bag. The dumpster bag has four sides defining an open top portion and an open bottom portion. A rear side of the dumpster bag is configured to wrap around the open bottom portion of the bag to define a temporary bottom surface adjacent to the open bottom portion. Strapping is disposed on the rear side of the dumpster bag and extends from an upper portion of the dumpster bag along the length of the rear side of the bag, wraps around the open bottom portion of the bag, and is removably secured to one or more attachment portions on the front side of the bag. The rear side of the bag can be selectively released via a quick release shackle having a pull cord.

11 Claims, 14 Drawing Sheets

(56) References Cited

U.S. PATENT DOCUMENTS

| | | | | |
|---|---|---|---|---|
| 5,975,759 | A * | 11/1999 | Renaud | B66C 1/226 141/10 |
| 5,984,134 | A | 11/1999 | Mario | |
| 6,431,753 | B1 * | 8/2002 | Rogers | B65D 88/1668 383/24 |
| 6,467,955 | B1 * | 10/2002 | Kim | B65D 88/1612 383/105 |
| 6,834,995 | B1 * | 12/2004 | Stevens | B65D 88/1668 383/41 |
| 7,798,712 | B2 | 9/2010 | Russick | |
| 8,322,924 | B2 | 12/2012 | Noble et al. | |
| 9,114,958 | B1 | 8/2015 | DiSpazio | |
| 9,169,061 | B2 | 10/2015 | Blanchard et al. | |
| 9,174,810 | B1 | 11/2015 | DiSpazio | |
| D799,773 | S | 10/2017 | Beiler | |
| 2001/0000464 | A1 | 4/2001 | Beale | |
| 2010/0002960 | A1 * | 1/2010 | Lasko | B62B 3/106 383/22 |
| 2010/0272378 | A1 * | 10/2010 | Mueller | B65D 90/205 383/67 |
| 2012/0193354 | A1 * | 8/2012 | Cavenagh | B65F 1/1415 220/9.3 |
| 2013/0330023 | A1 | 12/2013 | McGeoghean | |
| 2020/0130929 | A1 * | 4/2020 | Mullins | B65F 1/0006 |

FOREIGN PATENT DOCUMENTS

| | | | | |
|---|---|---|---|---|
| GB | 2515898 | A * | 1/2015 | B65F 1/125 |
| JP | 2001106291 | A * | 4/2001 | B65D 88/1681 |
| WO | WO-2005019044 | A2 * | 3/2005 | B65F 1/0006 |
| WO | 2007108833 | A2 | 9/2007 | |
| WO | WO-2013004770 | A1 * | 1/2013 | B65D 88/58 |

* cited by examiner

APPARATUS AND SYSTEM FOR BOTTOMLESS WASTE DISPOSAL BAG

CROSS-REFERENCE TO RELATED APPLICATIONS

The present application claims the benefit of U.S. provisional application 62/752,795 filed Oct. 30, 2018, the contents of which are hereby incorporated by reference herein in their entirety.

FIELD

The present disclosure relates to the field of dumpsters and bulk dry storage containers; in particular, an apparatus and system for a bottomless waste disposal and bulk storage bag apparatus and system.

BACKGROUND

Large trash containers, known as dumpsters, are commonly used at construction and residential sites where large quantities of trash are generated. Public health and environmental pollution issues necessitate the safe collection, containment, transportation, and disposal means of solid wastes. Problems occur with metal dumpsters during the emptying of the trash inside of dumpsters by the accidental dispersal of the trash as it is being discharged into the hopper of the front loading truck as well as problems stemming from the decay of the dumpster itself over time. Use of metal dumpsters requires lead time for placement of an order and delivery of the same which can result in unwanted delays in the commencement of work. Further, traditional metal dumpsters are heavy and expensive to lease or to purchase. Acquisition and maintenance of a metal dumpster can increase costs as well as force work stoppage.

In recent years, a number of solutions have emerged for bulk waste disposal bags as a cost effective alternative to traditional metal dumpsters. One such example is U.S. Pat. No. 7,798,712 entitled "Large Capacity Waste Disposal Bag," which discloses a large capacity waste disposal bag including loops attached to it. One set of loops may be used to raise and lower the bag during transportation. Another set of loops may be connected to adjacent loops to support and maintain the bag in an upright, open position. In another embodiment, a large capacity waste disposal bag includes pockets attached to it. When support members are inserted into the pockets the bag is supported and maintained in an upright, open position.

Another such example is U.S. Pat. No. 8,322,924 entitled "Trash Collection and Removal System," which discloses a trash collection and removal system that includes a flexible, foldable heavy-duty dumpster bag configured to engage with specially designed clamps that are secured onto the tines of a front loader truck and that engage with the dumpster bag by means of connecting and receiving pipes, and International Application No. WO2007/108833A2, entitled "Bulk Material Handling System and Apparatus, published Sep. 27, 2007, which comprises a PVC pipe rim stays and sewn-in corner stay panels.

While these prior art solutions do generally provide a solution for reduced cost and improved ease of setup when compared to traditional steel dumpster solutions, the use of flexible/foldable bulk waste disposal apparatuses has given rise to additional problems. Namely, flexible/foldable bulk waste disposal bags are difficult to empty compared to traditional steel dumpsters. These bags must be inverted in order to empty their contents, which is challenging to accomplish since the bags lack structural integrity and contents often get stuck and tangled during the process of emptying the bags. Special equipment is generally needed in order to empty these bags and recover them for reuse.

Certain solutions have attempted to solve the problem of emptying of flexible/foldable bulk waste disposal bags. An example of such attempts can be found in U.S. Pat. No. 9,174,810 entitled "Waste Bag Use Methods and Apparatus," which discloses a method for using a dumpster bag, the bag comprising: a flexible bag member including a bottom and a sidewall structure extending upward from the bottom to a rim; and a plurality of loops. The method comprises: engaging a hoist to a group of the loops; using the hoist to lift the bag containing contents; releasing the hoist from one or more of the loops; and using the hoist to again lift the bag to discharge the contents from the bag. Despite devising a solution to tip the bag to one side, U.S. Pat. No. 9,174,810 still requires the bag to be substantially inverted, at least on one side, in order to empty its contents. This requires specialized equipment and is difficult to perform in practice.

What is needed, therefore, is a flexible/foldable bulk waste disposal bag that is faster and safer to empty than prior art solutions for waste disposal and bulk storage bags. Through applied effort, ingenuity, and innovation, Applicant has identified a number of deficiencies and problems with waste disposal and bulk storage bags. Applicant has developed a solution that is embodied by the present invention, which is described in detail below.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present disclosure is a reusable dumpster bag that can be rolled and unrolled for storage and setup, and is configured to be emptied via the bottom of the bag. The dumpster bag has four sides defining an open top portion and an open bottom portion. A rear side of the dumpster bag is configured to wrap around the open bottom of the bag to define a temporary bottom surface adjacent to the open bottom portion. Strapping is disposed on the rear side of the dumpster bag and extends from the upper portion of the dumpster bag along the length of the rear side of the bag, wraps around the open bottom portion of the bag, and is removably secured to one or more attachment portions on the front side of the bag. The strapping creates structural integrity for the temporary bottom surface portion of the bag to enable the bag to be loaded with trash or other dry material and lifted via one or more lifting straps coupled to an upper portion of the bag. A quick release shackle is coupled to the strapping, and a pull cord is attached to the quick release shackle. The contents of the bag may be emptied by pulling the pull cord to disengage the quick release shackle. Once the quick release shackle is disengaged, the rear side of the dumpster bag is released, thereby disengaging the temporary bottom surface of the bag defined by wrapping the rear side of the bag around the open bottom portion of the bag. The contents of the bag are evacuated through the open bottom portion of the bag, and the bag may be again set up for further use.

Another object of the present disclosure is a method for using a containment apparatus, the containment apparatus comprising a front panel, a right side panel, a left side panel, and a rear panel being coupled together to define an interior portion comprising an open top and an open bottom, the rear panel having a flap being configured to extend across an area of the open bottom and around at least a lower portion of the front panel; at least one strap disposed on a surface of the rear panel; and, at least one connecting portion disposed on a surface of the front panel, the method comprising extending the flap of the rear panel across the area of the open bottom and around at least a lower portion of the front panel; interfacing the at least one strap with at least one connecting portion; lifting the waste disposal bag via a plurality of loops disposed on an upper surface of the waste disposal bag; disconnecting the at least one strap from at least one connecting portion using a pull cord; and, extending the flap of the rear panel to expose the open bottom of the waste disposal bag.

Another object of the present disclosure is a method for using a waste disposal bag, the waste disposal bag comprising a front panel, a right side panel, a left side panel, and a rear panel being coupled together to define an interior portion comprising an open top and an open bottom, the rear panel having a flap being configured to extend across an area of the open bottom and around at least a lower portion of the front panel; one or more straps disposed on a surface of the rear panel; and, at least two loops disposed on a surface of the front panel, the method comprising extending the flap of the rear panel across the area of the open bottom and around at least a lower portion of the front panel; interfacing a first strap of the one or more straps with a first loop of the at least two loops; interfacing a second strap of the one or more straps with a second loop of the at least two loops; removably coupling the first strap to the second strap; lifting the waste disposal bag using a plurality of loops disposed on an upper surface of the waste disposal bag; disconnecting the first strap from the second strap using a pull cord; and, extending the flap of the rear panel to expose the open bottom of the waste disposal bag.

Specific embodiments of the present disclosure provide for a waste disposal apparatus comprising a front panel, a left side panel, a right side panel, and a rear panel, the front panel and the right side panel being partially coupled together along approximately half of a left edge of the right side panel, the rear panel and the right side panel being partially coupled together along approximately half of a right edge of the right side panel, the front panel and the left side panel being partially coupled together along approximately half of a right edge of the left side panel, the rear panel and the left side panel being partially coupled together along approximately half of a left edge of the left side panel, the front panel, the left side panel, the right side panel, and the rear panel being coupled together to define an open top portion and an open bottom portion; a first connecting strap and a second connecting strap coupled to an upper edge of the front panel, the first connecting strap and the second connecting strap each comprising an upper loop and a lower loop; a first pair of straps coupled to an outer surface of the rear panel from an upper edge of the rear panel to a lower edge of the rear panel, the first pair of straps being coupled together at a first end to define a loop and being coupled together to overlap at a second end; a second pair of straps coupled to an outer surface of the rear panel adjacent to the first pair of straps from the upper edge of the rear panel to the lower edge of the rear panel, the second pair of straps being coupled together at a first end to define a loop and being coupled together to overlap at a second end, the rear panel, the first pair of straps, and the second pair of straps being configured to extend across the open bottom portion and around a portion of the front panel to define a bottom surface, the second end of the first pair of straps being configured to extend through the lower loop of the first connecting strap, and the second end of the second pair of straps being configured to extend through the lower loop of the second connecting strap, the second end of the first pair of straps and the second end of the second pair of straps being configured to be removably coupled together.

Further specific embodiments of the present disclosure provide for a waste disposal apparatus comprising a front side wall, a right side wall, a left side wall, and a rear side wall being coupled together to define an interior portion comprising an open top and an open bottom, the right side wall having a flap being configured to extend over a right portion of the open bottom, the left side wall having a flap being configured to extend over a left portion of the open bottom, and the rear side wall having a flap being configured to extend across an area of the open bottom and around at least a lower portion of the front side wall; at least one pair of loops disposed on the front side walls; at least one pair of straps coupled to the rear side walls and being configured to interface with the at least one pair of loops, the at least one pair of straps being configured to be removably coupled together when interfaced with the least one pair of loops; and, at least two lifting loops disposed on an upper portion of the front side wall, and at least two lifting loops disposed on an upper portion of the rear side wall.

Still further specific embodiments of the present disclosure provide for a waste disposal system comprising a foldable storage bag, the foldable storage bag comprising a front side wall, a right side wall, a left side wall, and a rear side wall being coupled together to define an interior portion comprising an open top and an open bottom, the right side wall having a flap being configured to extend over a right portion of the open bottom, the left side wall having a flap being configured to extend over a left portion of the open bottom, and the rear side wall having a flap being configured to extend across an area of the open bottom and around at least a lower portion of the front side wall; at least one pair of loops disposed on the front side wall; at least one pair of straps coupled to the rear side walls and being configured to interface with the at least one pair of loops, the at least one pair of straps being configured to be removably coupled together when interfaced with the at least one pair of loops; at least two lifting loops disposed on an upper portion of the front side wall, and at least two lifting loops disposed on an upper portion of the rear side wall; at least one quick release shackle removably coupled to the at least one pair of straps when interfaced with the at least one pair of loops; and, a pull cord operably engaged with the quick release shackle.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 1:
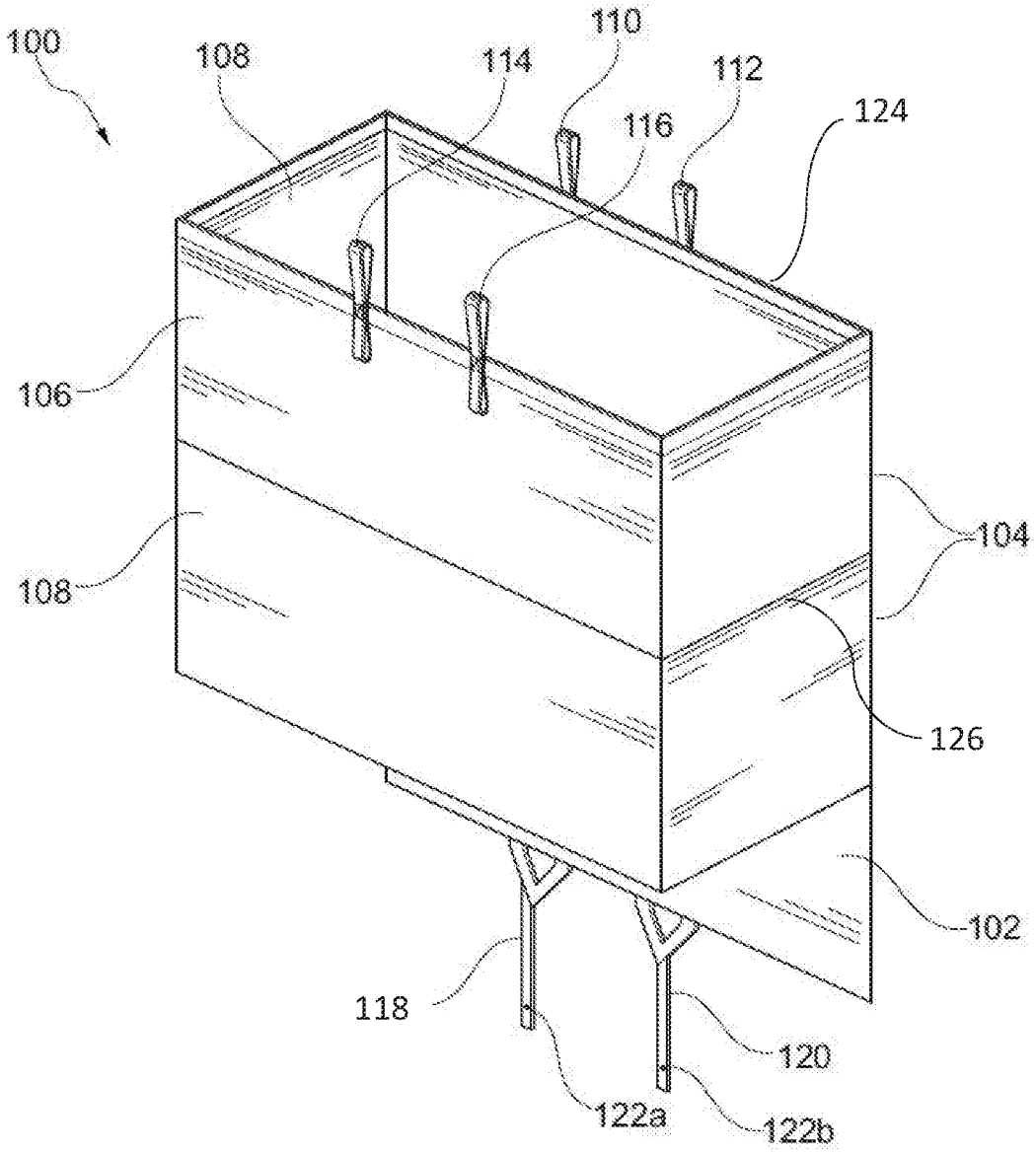
FIG. 1 is a perspective view of a waste disposal bag, according to an embodiment of the present invention.

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Where possible, any terms expressed in the singular form herein are meant to also include the plural form and vice versa, unless explicitly stated otherwise. Also, as used herein, the term "a" and/or "an" shall mean "one or more," even though the phrase "one or more" is also used herein. Furthermore, when it is said herein that something is "based on" something else, it may be based on one or more other things as well. In other words, unless expressly indicated otherwise, as used herein "based on" means "based at least in part on" or "based at least partially on." Like numbers refer to like elements throughout.

The terminology used herein is for describing particular embodiments only and is not intended to be limiting of the embodiments. As used herein, the singular forms "a," "an," and "the" are intended to include the plural forms as well, unless the context clearly indicates otherwise. It will be further understood that the terms "comprises," "comprising," "includes," and/or "including,", and variants thereof, when used herein, specify the presence of stated features, steps, operations, elements, and/or components, but do not preclude the presence or addition of one or more other features, steps, operations, elements, components, and/or groups thereof.

It will be understood that when an element is referred to as being "coupled," "connected," or "responsive" to another element, it can be directly coupled, connected, or responsive to the other element, or intervening elements may also be present. In contrast, when an element is referred to as being "directly coupled," "directly connected," or "directly responsive" to another element, there are no intervening elements present. As used herein, the term "and/or" includes any and all combinations of one or more of the associated listed items.

Spatially relative terms, such as "above," "below," "upper," "lower," "top, "bottom," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" other elements or features would then be oriented "above" the other elements or features. Thus, the term "below" can encompass both an orientation of above and below. The device may be otherwise oriented (rotated 90 degrees or at other orientations) and the spatially relative descriptors used herein interpreted accordingly. Well-known functions or constructions may not be described in detail for brevity and/or clarity.

It will be understood that, although the terms "first," "second," etc. may be used herein to describe various elements, these elements should not be limited by these terms. These terms are only used to distinguish one element from another. Thus, a first element could be termed a second element without departing from the teachings of the present embodiments. Unless otherwise defined, all terms (including technical and scientific terms) used herein have the same meaning as commonly understood by one of ordinary skill in the art to which these embodiments belong. It will be further understood that terms, such as those defined in commonly-used dictionaries, should be interpreted as having a meaning that is consistent with their meaning in the context of the relevant art and will not be interpreted in an idealized or overly formal sense unless expressly so defined herein.

Embodiments of the present disclosure provide for a fabric waste disposal or dry storage bag with an open top and open bottom. The waste disposal bag of the present disclosure may be constructed of polypropylene fabric with polypropylene strapping disposed on at least a rear panel of the waste disposal bag. The waste disposal bag may be comprised of a front panel, a left side panel, a right side panel, and a rear panel. The panels may be sewn together at an upper portion of each panel to define corners of the bag and may be disconnected at a lower portion of each panel to define a flap portion along the lower half of each panel. The flap portion of the right side panel, the left side panel, and the front panel may be folded inward toward the area defining the open bottom portion. When folded toward the area defining the open bottom, the flap portion of the right side panel, the left side panel, and the front panel may define a temporary bottom surface. The flap portion of the rear panel may be approximately double the length of the flap portion of the right side panel and the left side panel. The flap portion of the rear panel may be wrapped under the area defining the open bottom of the bag, and around a portion of the front panel. Strapping may be disposed on the length of the rear panel from an upper portion of the rear panel to a lower portion of the rear panel. When the rear panel is wrapped around the bottom portion of the bag, the straps may be interfaced with one or more connecting portions being disposed on the front panel. The strapping may be selectively coupled together at an end portion via a quick release shackle to temporarily secure the rear panel around the open bottom portion. When the strapping is interfaced with the one or more connecting portions, and the strapping is secured together via the quick release shackle, the bag is configured to receive trash and/or other contents. The bag may be lifted via one or more loops disposed on an upper portion of the bag and may be lifted via a crane for emptying into a dumpster. The contents of the waste disposal bag may be emptied by pulling on a pull cord attached to the quick release shackle. The pull cord may disengage the quick release shackle, thereby causing the strapping to slide out of the one or more connecting portions disposed on the front panel. With the strapping disengaged from the one or more connecting portions disposed on the front panel, the weight of the bag's contents causes the flaps of the rear panel, front panel, right side panel, and left side panel to be displaced, and the contents of the bag to be evacuated out of the open bottom portion of the bag. Upon emptying the bag, the bag may be lowered from the crane and reconfigured for the next use.

Referring now to FIG. 1, a perspective view of a waste disposal bag 100 is shown. According to an embodiment of the present disclosure, a waste disposal bag 100 is comprised of a rear panel 102, a right panel 104, a front panel 106, and a left panel 108. Front panel 106 is partially coupled along a right edge of front panel 106 to a left edge of the right panel 104, such that approximately the upper half of the length of the right edge of front panel 106 and upper half of the length of the left edge of the right panel 104 are coupled together; and the lower half of the length of the right edge of front panel 106 and lower half of the length of the left edge of the right panel 104 are disconnected to define a flap portion. Likewise, front panel 106 is partially coupled along an upper portion of the left edge of front panel 106 to an upper portion of the right edge of left panel 108. Rear panel 102 is partially coupled along an upper portion of its edges to an upper portion on right panel 104 at a first side and left panel 108 at a second side. Rear panel 102, right panel 104, front panel 106, and left panel 108 are coupled together to define an open top area 124 at an upper end and an open bottom area 126 at a lower end. Connecting strap 114 and connecting strap 116 may be coupled to an upper portion of front panel 106 adjacent to open top area 124. Lifting strap 110 and lifting strap 112 may be coupled to an upper portion of rear panel 102 adjacent to open top area 124. Strap 202, strap 204, strap 206, and strap 208 (see FIG. 2) may be coupled to an exterior surface of rear panel 102. Strap 202 and strap 204 may overlap and be coupled together at an end 214; and, strap 206 and strap 208 may overlap and be coupled together at an end 212. A sleeve 118 may be disposed over end 214 of strap 202 and strap 204; and, a sleeve 120 may be disposed over the end 212 of strap 206 and strap 208. A grommet 122*a* may extend through the sleeve 118 and end 214, and a grommet 122*b* may extend through sleeve 120 and end 212. Rear panel 102, right panel 104, front panel 106, and left panel 108 may be constructed of polypropylene fabric or similar material; and, straps 202, 204, 206, and 208 may be constructed of polypropylene strapping or similar strapping material.

Figure 2A:
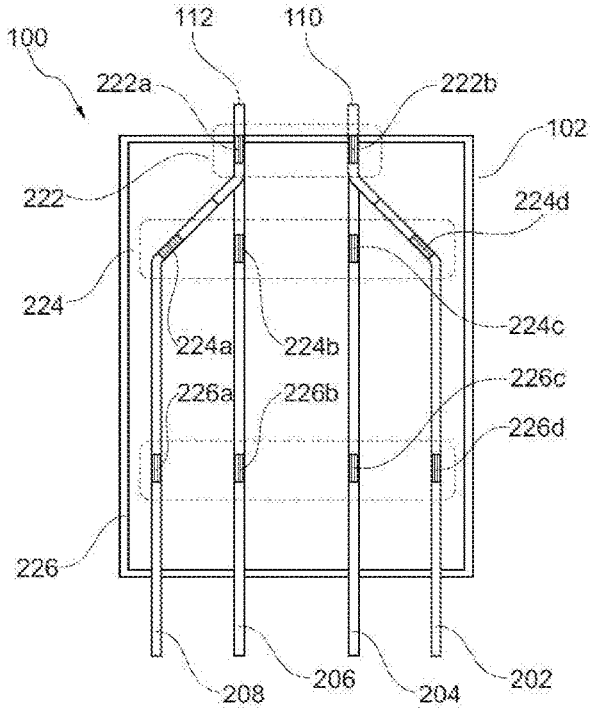
FIG. 2A is a side plan view of a waste disposal bag, according to an embodiment of the present invention.
Figure 2B:
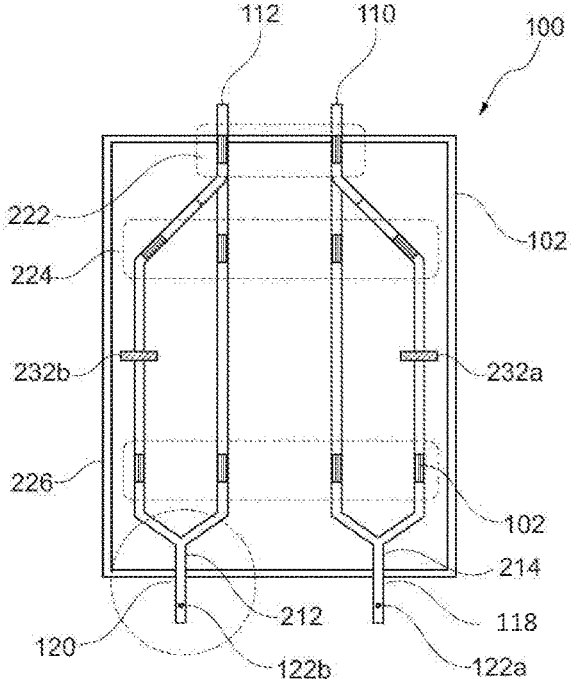
FIG. 2B is a side plan view of a waste disposal bag, according to an embodiment of the present invention.
Figure 3A:
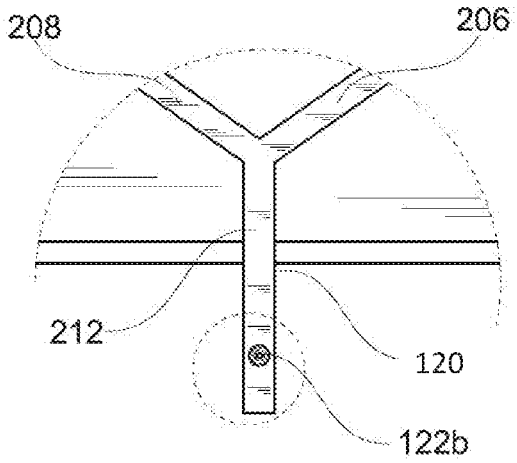
FIG. 3A is a perspective view of a retaining strap of a waste disposal bag, according to an embodiment of the present invention.
Figure 3B:
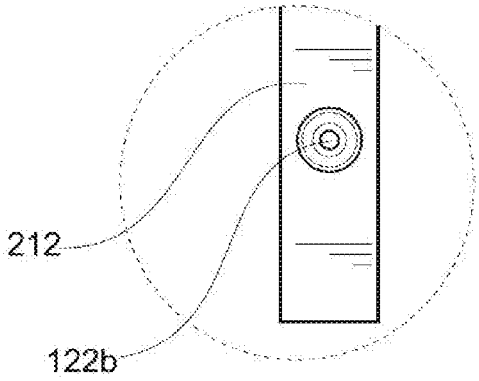
FIG. 3B is a perspective view of a grommet of the retaining strap, according to an embodiment of the present invention.

Referring now to FIGS. 2A and 2B, a side plan view of waste disposal bag 100 is shown. According to an embodiment of the present disclosure, a detailed view of rear panel 102 is shown. Rear panel 102 may comprise lifting strap 110 and lifting strap 112 coupled to an upper end of rear panel 102. Straps 208 and 206 may extend from an upper end of rear panel 102 to a lower end of rear panel 102. Strap 206 may be substantially aligned with lifting strap 112 from the upper end to the lower end of rear panel 102. Strap 208 may extend outward at an angle from lifting strap 112 toward an outer edge of rear panel 102 from reinforcing area 222 to reinforcing area 224; and, may extend downward from reinforcing area 224 parallel to strap 206 to the lower end of rear panel 102. Straps 202 and 204 may extend from an upper end of rear panel 102 to a lower end of rear panel 102. Strap 204 may be substantially aligned with lifting strap 110 from the upper end to the lower end of rear panel 102. Strap 202 may extend outward at an angle from lifting straps 110 toward an outer edge of rear panel 102 from reinforcing area 222 to reinforcing area 224, and may extend downward from reinforcing area 224 parallel to strap 204 to the lower end of rear panel 102. Reinforcing stitching 222*a* may be disposed on straps 208 and 206 at reinforcing area 202. Reinforcing stitching 224*a* may be disposed on strap 208 at reinforcing area 224. Reinforcing stitching 224*b* may be disposed on strap 206 at reinforcing area 224. Reinforcing stitching 226*a* may be disposed on strap 208 at reinforcing area 226. Reinforcing stitching 226*a* may be disposed on strap 206 at reinforcing area 226. Reinforcing stitching 222*b* may be disposed on straps 204 and 202 at reinforcing area 222. Reinforcing stitching 224*c* may be disposed on strap 204 at reinforcing area 224. Reinforcing stitching 224*d* may be disposed on strap 202 at reinforcing area 224. Reinforcing stitching 226*d* may be disposed on strap 202 at reinforcing area 226. Reinforcing stitching 226*c* may be disposed on strap 204 at reinforcing area 226. Strap 208 and strap 206 may be overlapped and coupled together to define strap end 212. Strap 204 and strap 202 may be coupled together at strap end 214. Sleeve 120 may be disposed over strap end 212, and sleeve 118 may be disposed over strap end 214. Grommet 122*b* may extend through sleeve 120 and strap end 212, and grommet 122*a* may extend through strap end 214 and sleeve 118 (as shown in FIGS. 3A, 3B and 2B).

According to an embodiment, grommets 122*a* and 122*b* may be configured to have a diameter in the range of about 1 inch to about 1.5 inches.

Figure 4A:
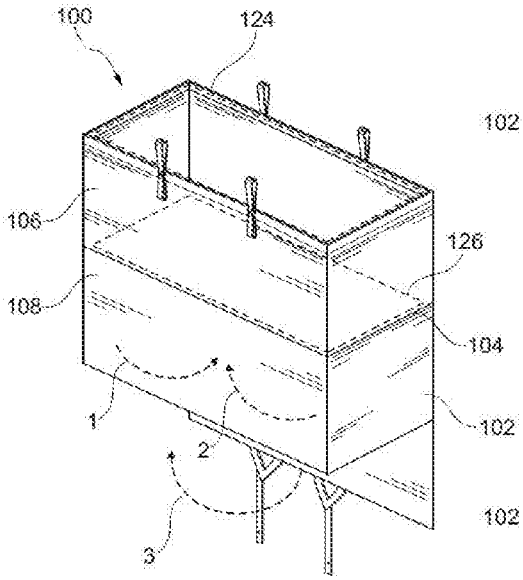
FIG. 4A is a perspective view of a waste disposal bag, according to an embodiment of the present invention.
Figure 4B:
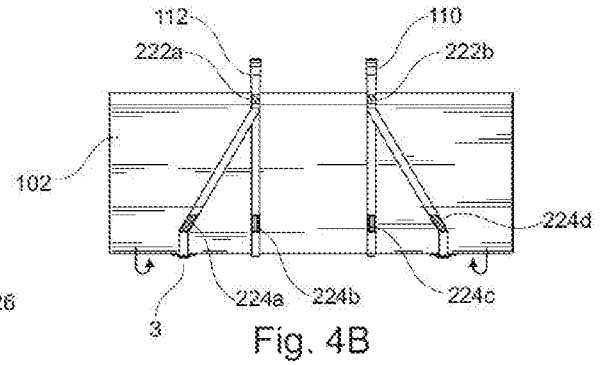
FIG. 4B is a plan view of a waste disposal bag, according to an embodiment of the present invention.
Figure 4C:
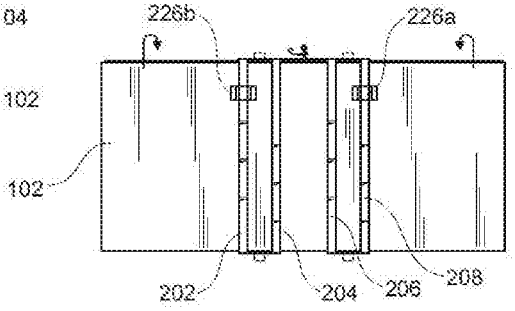
FIG. 4C is a plan view of a waste disposal bag, according to an embodiment of the present invention.

Referring now to FIGS. 4A, 4B, and 4C, a perspective view and plan view of waste disposal bag apparatus 100 is shown. According to an embodiment of the present disclosure, the lower portion of right panel 104, the lower portion of front panel 106, and the lower portion of left panel 108 are folded to define a bottom surface of open bottom area 126. The lower portion or flap of right panel 104 is folded inward toward open bottom area 126, and the lower portion or flap of left panel 108 is folded inward toward open bottom area 126. The lower portion or flap of front panel 106 is folded backward toward open bottom area 126. Once the lower portions of front panel 106, right panel 104, and left panel 108 are folded inward toward open bottom area 126, then rear panel 102 is wrapped around open bottom area 126 to front panel 106 to define a temporary bottom surface of open bottom area 126.

Figure 5A:
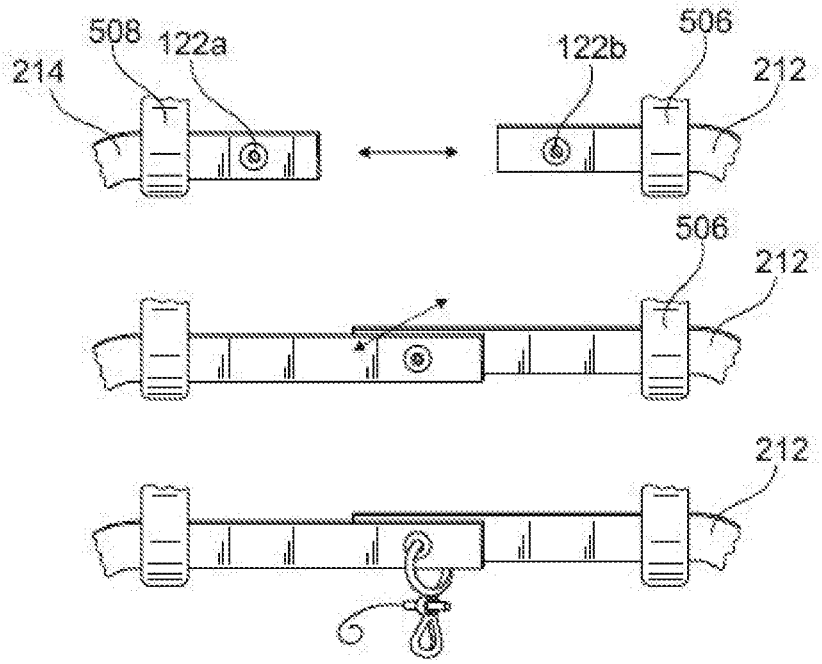
FIG. 5A is a functional view of the retaining straps of a waste disposal bag, according to an embodiment of the present invention.
Figure 5B:
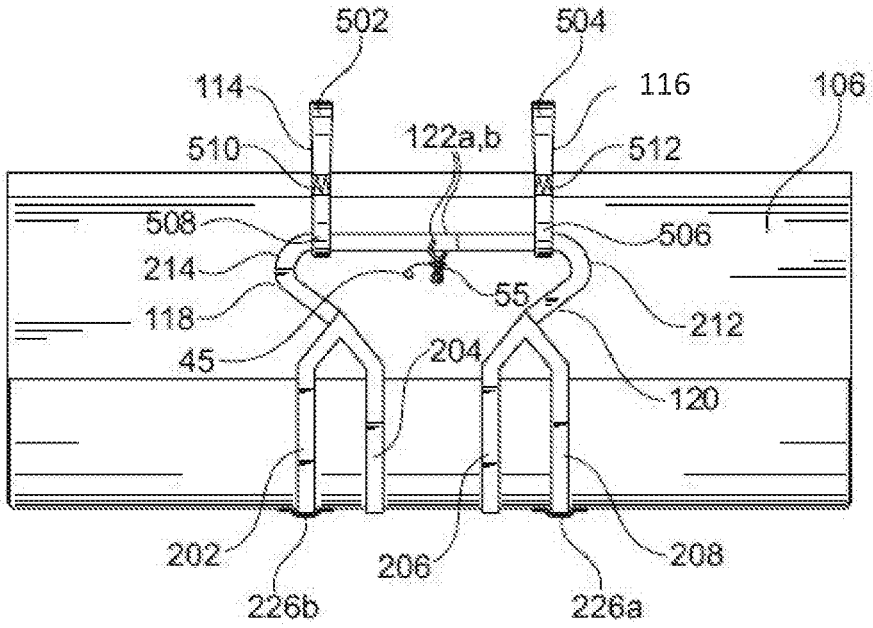
FIG. 5B is a plan view a waste disposal bag, according to an embodiment of the present invention.

Referring now to FIGS. 5A and 5B, a functional view and a plan view of waste disposal bag 100 is shown. According to an embodiment of the present invention, connecting strap 114 is comprised of upper loop 502 and lower loop 508, and connecting strap 116 is comprised of upper loop 504 and lower loop 506. Connecting strap 114 may be coupled to front panel 106 via reinforcing stitching 510, and connecting strap 116 may be coupled to front panel 106 via reinforcing stitching 512. As discussed in FIGS. 4A, 4B, and 4C, rear panel 102 is wrapped around waste disposal bag 100 such that a bottom edge of rear panel 102 is in contact with front panel 106. Rear panel 102 is removably coupled to front panel 106 via strap end 212, and strap end 214. Strap end 212 and sleeve 120 are threaded through lower loop 506 from the lateral side to the medial side of lower loop 506. Strap end 214 and sleeve 118 are threaded through lower loop 508 from the lateral side to the medial side of lower loop 508. Strap end 212 and strap end 214 are pulled together to meet at an approximate midline of front panel 106. Strap end 212 is positioned to overlap strap end 214 such that grommet 122*a* and grommet 122*b* are aligned. Quick release shackle 55 is coupled to grommet 122*a* and grommet 122*b* such that strap end 212 and strap end 214 are retained in a fixed position. Pull cord 45 is operably coupled to a release mechanism of quick release shackle 55.

Figure 6A:
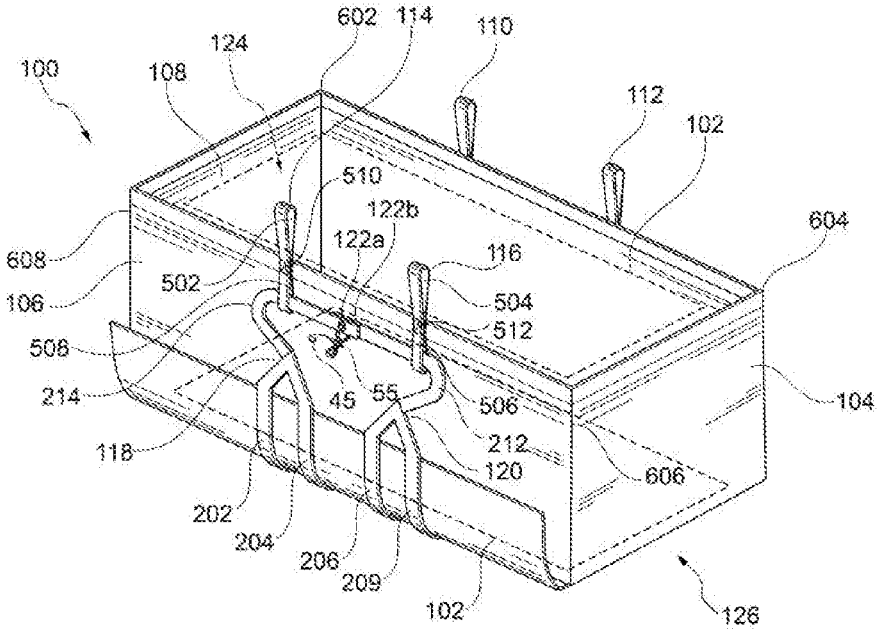
FIG. 6A is a perspective view of a waste disposal bag, according to an embodiment of the present invention.

Referring now to FIG. 6A, a perspective view of waste disposal bag 100 is shown. According to an embodiment of the present invention, as shown in FIGS. 5A and 5B, waste disposal bag 100 is shown in an engaged configuration. Waste disposal bag 100 may further comprise a pole 602, pole 604, pole 606, and pole 608 coupled to each respective corner of waste disposal bag 100 in order to provide rigidity to waste disposal bag 100 when empty or partially filled. In an alternative embodiment, poles 602, 604, 606, and 608 are substituted with elongated structural inserts that may be constructed of a rigid plastic or polymeric material. The elongated structural inserts may interface with a receiving pocket or channel disposed on the surface of waste disposal bag. An upper end and a lower end of each structural insert interfaces with an upper surface and a lower surface of each receiving pocket or channel to apply pressure to the corner perimeters of waste disposal bag 100 and provide structural integrity such that the corners of waste disposal bag 100 are configured to stand upright during use of waste disposal bag 100. As described above, rear panel 102 defines a temporary bottom surface of waste disposal bag 100, when configured in an engaged configuration as shown in FIG. 6A. When in an engaged position, a user of waste disposal bag 100 may fill waste disposal bag 100 with waste, debris, or other bulk material(s) in order to dispose of or store such items. Waste disposal bag 100 may be lifted by connecting a hoist to lifting straps 110 and 112 and upper loop 502 and upper loop 504. When waste disposal bag 100 is lifted via lifting straps 110 and 112 and upper loop 502 and upper loop 504, pressure is applied to straps 202, 204, 206, and 208 via lifting straps 110 and 112 at a first end and via upper loop 502 and upper loop 504 at a second end. This creates a cinching or tightening effect such that rear panel 102 is secured along open bottom area 126 of waste disposal bag 100 when lifted during use.

Figure 6B:
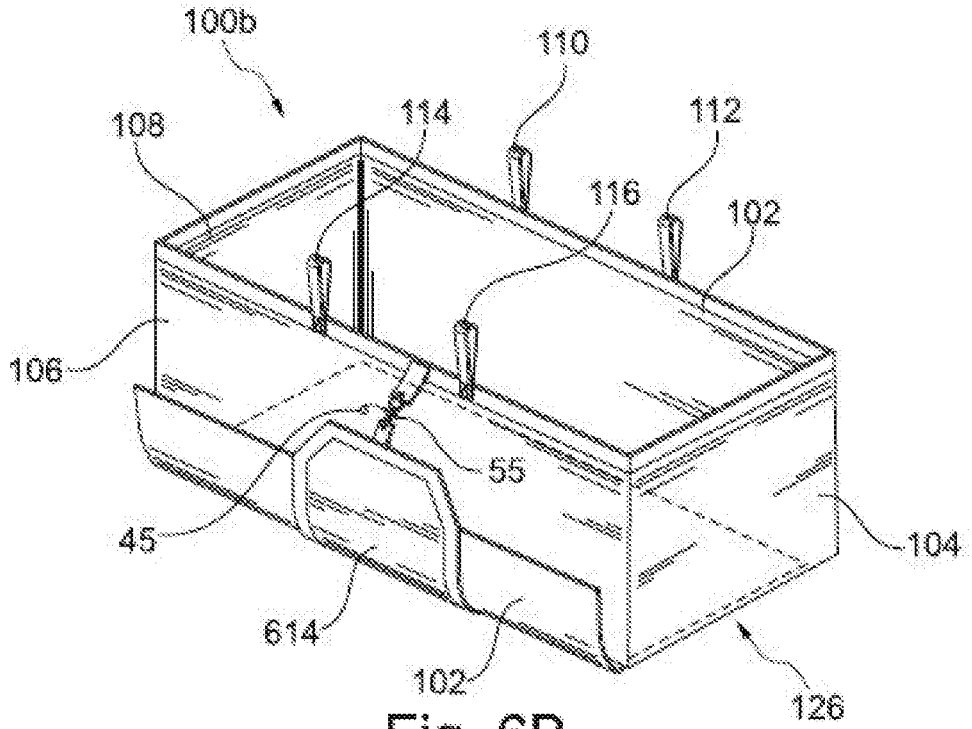
FIG. 6B is a perspective view of a waste disposal bag, according to an embodiment of the present invention.
Figure 6C:
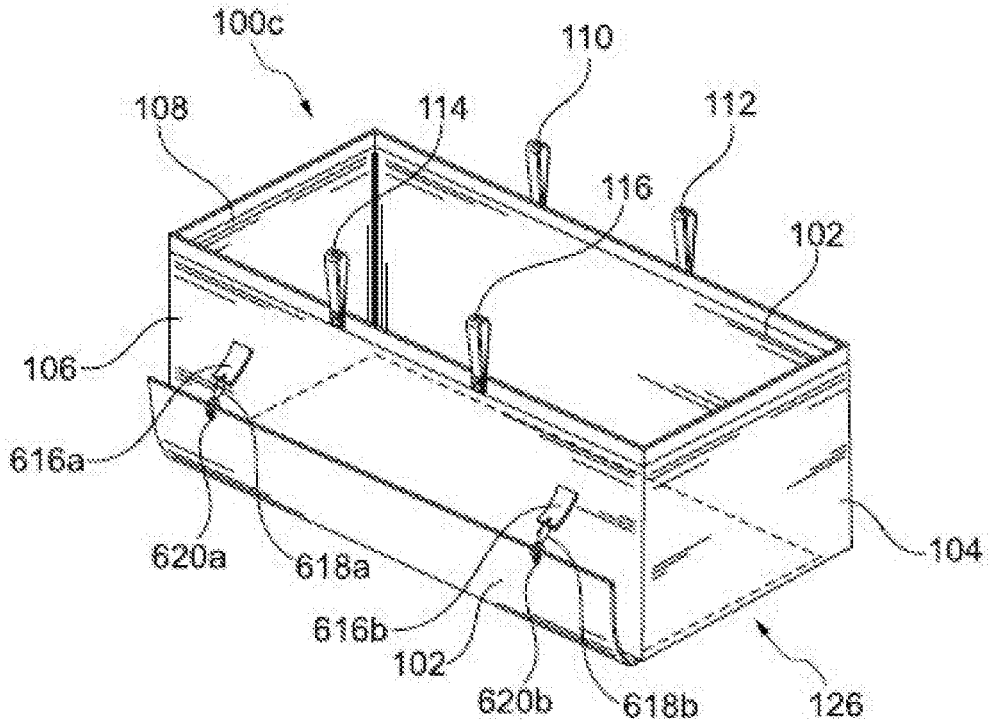
FIG. 6C is a perspective view of a waste disposal bag, according to an embodiment of the present invention.

Referring now to FIGS. 6B and 6C, a perspective view of waste disposal bag 100 is shown, according to alternative embodiments of the present disclosure. Referring now to FIG. 6B, waste disposal bag 100*b* is comprised of a single retaining strap 614 extending the entire length of rear panel 102. Strap 614 may be selectively attached to a front surface of panel 106 via quick release shackle 55. Alternatively, retaining strap 614 may extend from right panel 104 to left panel 108, or vice versa. As described above, pull cord 45 is operably coupled to a release mechanism of quick release shackle 55. In another alternative embodiment, and referring now to FIG. 6C, waste disposal bag 100*c* does not incorporate any straps disposed on rear panel 102. Instead, rear panel 102 comprises rings or grommets 620*a* and 620*b* disposed on a bottom edge of rear panel 102. Front panel 106 may comprise connecting straps 616*a* and 616*b*. Rear panel 102 may be temporarily coupled to front panel 106 to define a temporary bottom surface of waste disposal bag 100*c* by coupling ring 620*a* to connecting strap 616*a* via a remote release shackle 618*a*, and coupling ring 620*b* to connecting strap 616*b* via a remote release shackle 618*b*. Remote release shackles 618*a* and 618*b* may be configured to be operably engaged with a remote control to remote release coupling ring 620*a* from connecting strap 616*a* and coupling ring 620*b* from connecting strap 616*b*.

Figure 7:
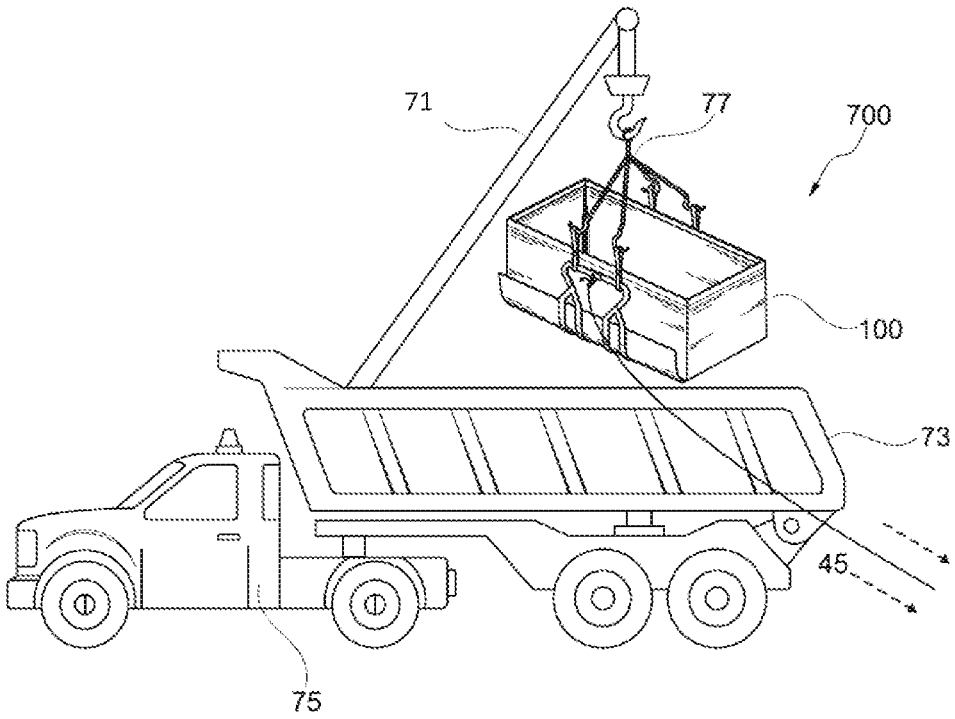
FIG. 7 is a functional view of a waste disposal bag system, according to an embodiment of the present invention.
Figure 8A:
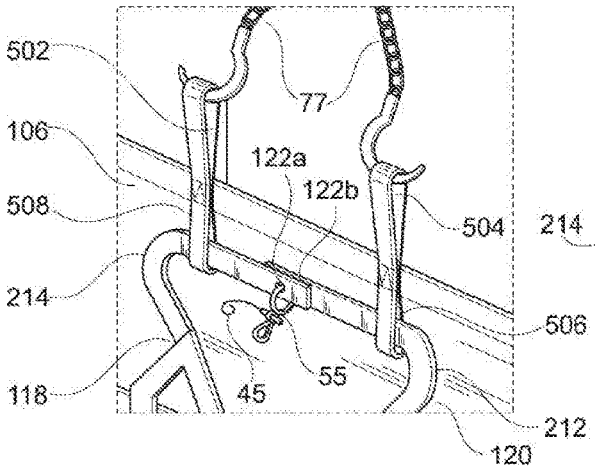
FIG. 8A is a functional view of a waste disposal bag system, according to an embodiment of the present invention.
Figure 8B:
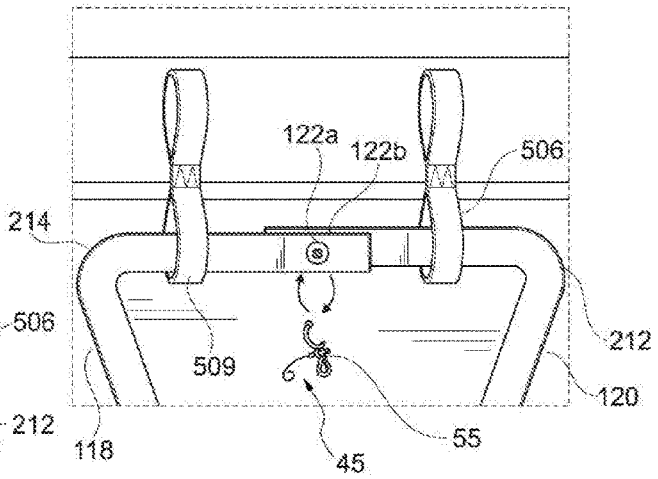
FIG. 8B is a functional view of a waste disposal bag system, according to an embodiment of the present invention.
Figure 9:
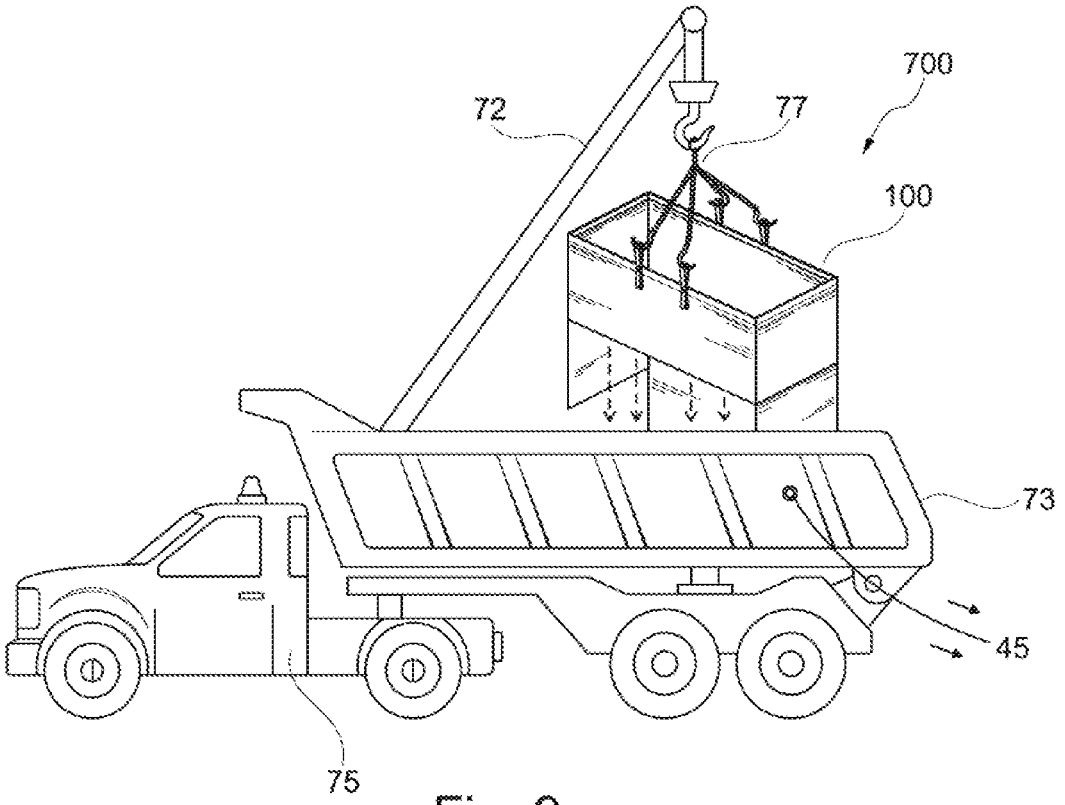
FIG. 9 is a functional view of a waste disposal bag system, according to an embodiment of the present invention.
Figure 10:
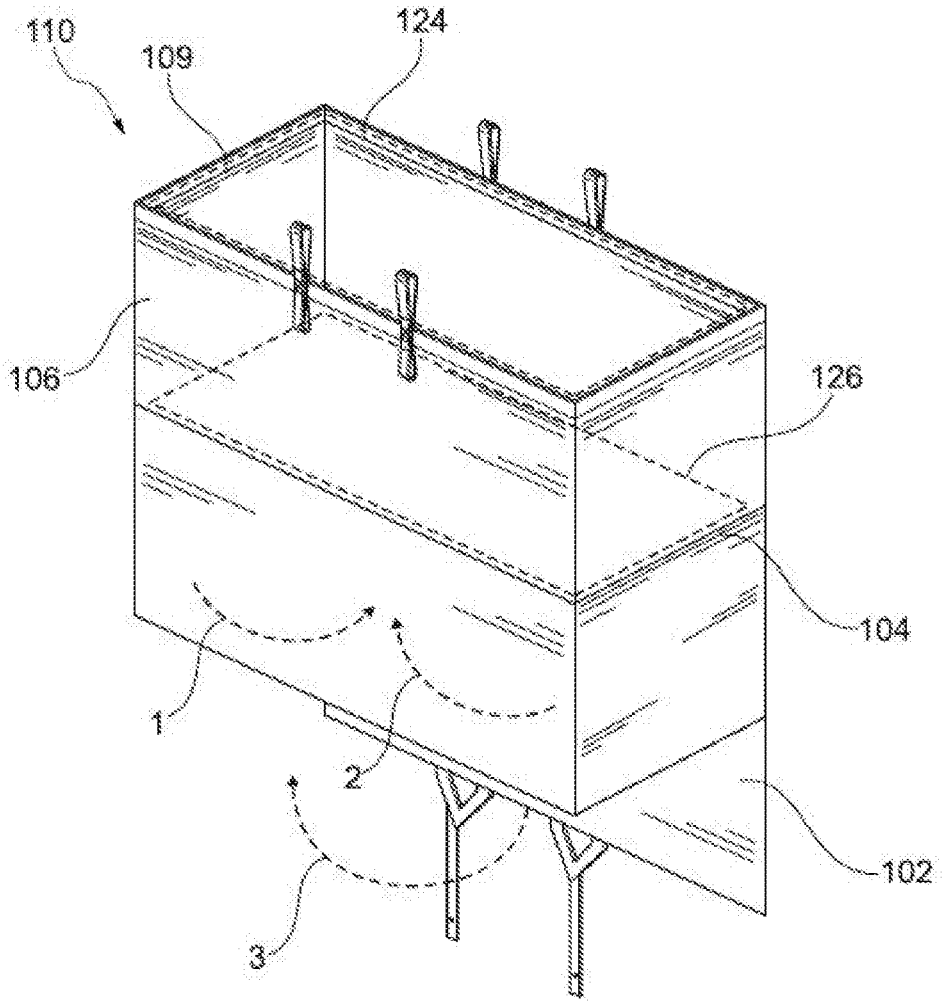
FIG. 10 is a perspective view of a waste disposal bag, according to an embodiment of the present invention.

Referring now to FIG. 7, a functional view of a waste disposal bag system 700 is shown. According to an embodiment of the present invention, waste disposal bag 100 is lifted via hoist, chain(s), strap(s) or other lifting apparatus 77 attached to crane 71 of dump truck, crane truck, box truck, grapple truck, dumpster, and/or trailer 75. Crane 71 positions waste disposal bag 100 over dump bed 73. As shown in FIG. 8A, lifting apparatus 77 may include one or more hooks that interface with upper loop 502 and upper loop 504 and lifting straps 110 and 112 (not shown in FIG. 8A). A user may remove quick release shackle 55 from grommet 122*a* and grommet 122*b* by pulling pull cord 45, as shown in FIGS. 7 and 8B. As shown in FIG. 9, upon releasing quick release shackle 55 (not shown), the contents of waste disposal bag 100 are evacuated out of the open bottom portion of waste disposal bag 100 into dump bed 73. As shown in FIG. 10, waste disposal bag 100 may be removed from lifting apparatus 77 (not shown) and setup again for use, as described above.

Figure 11:
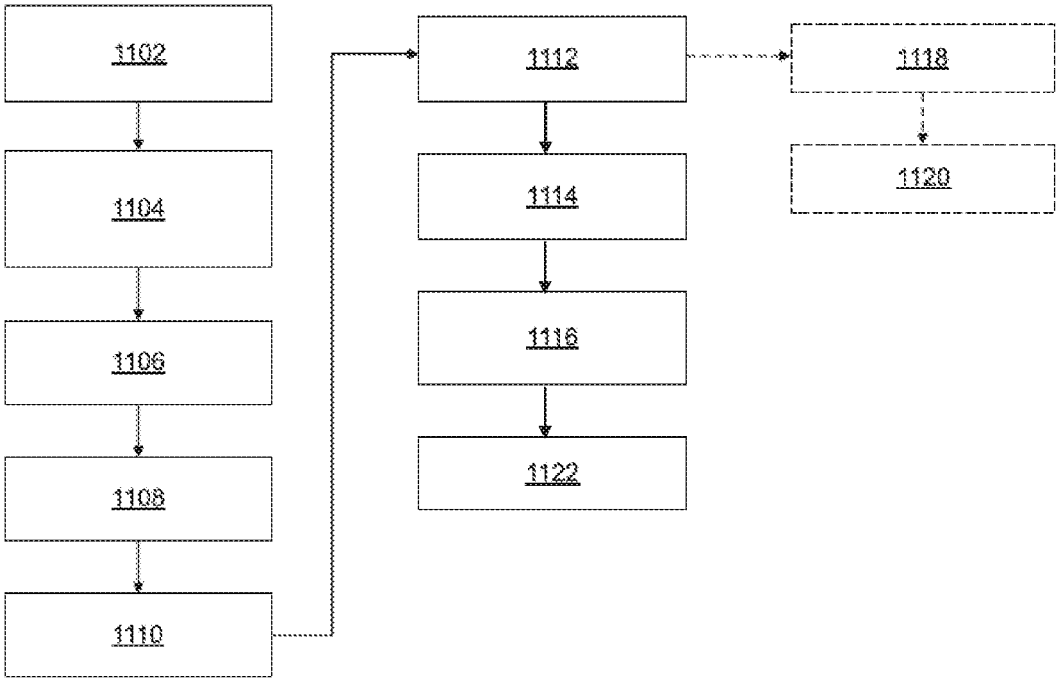
FIG. 11 is a process flow diagram of a method of use for a storage bag, according to an embodiment of the present invention.

Referring now to FIG. 11, a process flow diagram of a method of use for a storage bag is shown. According to an embodiment of the present disclosure, a user unfolds a waste disposal bag for setup 1102. A user extends a flap of the rear panel of the waste disposal bag back around and across an area defining an open bottom of the waste disposal bag, and around a portion of the front panel 1104. A user interfaces a first strap being coupled to the rear panel of the waste disposal bag with the first loop disposed on the front panel of the waste disposal bag 1106. The user interfaces a second strap being coupled to the rear panel of the waste disposal bag with the second loop disposed on the front panel of the waste disposal bag 1108. The user removably couples the first strap with the second strap via a quick release shackle 1110. The bag is now configured to receive contents, and the user may proceed to fill the bag with desired contents; for example, waste from a construction site. When the waste disposal bag is full, a user connects a hoist to a plurality of loops disposed on an upper portion of the waste disposal bag and may lift the waste disposal back via a crane arm attached to a dump truck 1112. Optionally, the crane operator may weigh the contents of the waste disposal bag using a crane scale or dynamometer 1118 and may generate an invoice for the user of the bag according to the weight of the bag 1120. A user may proceed to empty the waste disposal bag by disconnecting the first strap from the second strap using a pull cord operably engaged with the quick release shackle 1114. Upon disconnecting the first strap and the second strap via the pull cord, the flap of the rear panel will become disconnected from the front panel and will fall away to expose the open bottom of the waste disposal bag 1116. The contents of the waste disposal bag will be concurrently evacuated via the open bottom of the waste disposal bag upon disconnecting the rear panel from the front panel 1122.

Figure 12:
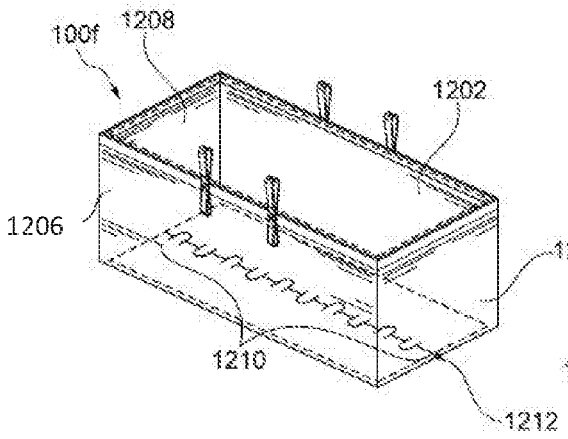
FIG. 12 is a perspective view of a waste disposal bag, according to an embodiment of the present invention.

The present invention may comprise a number of alternative embodiments, including but not limited to, the embodiments shown and described in FIGS. 12-15. Referring now to FIG. 12, a perspective view of an alternative embodiment of waste disposal bag 100*f* is shown. According to an embodiment of the present disclosure, waste disposal bag 100*f* is comprised of rear panel 1202, right panel 1204, front panel 1206, and left panel 1208. Rear panel 1202 and front panel 1206 may comprise a plurality of overlapping flaps defining a zipper-like portion 1210. The plurality of overlapping flaps may include a plurality of loops to receive a retaining rod 1212, which may extend from right panel 1204 to left panel 1208 and may interface with the plurality of overlapping flaps in order to temporarily couple rear panel 1202 to front panel 1206 to define a bottom surface of waste disposal bag 100*f*. A user may disconnect rear panel 1202 from front panel 1206 to expose the open bottom of waste disposal bag 100*f* by removing retaining rod 1212.

Figure 13:
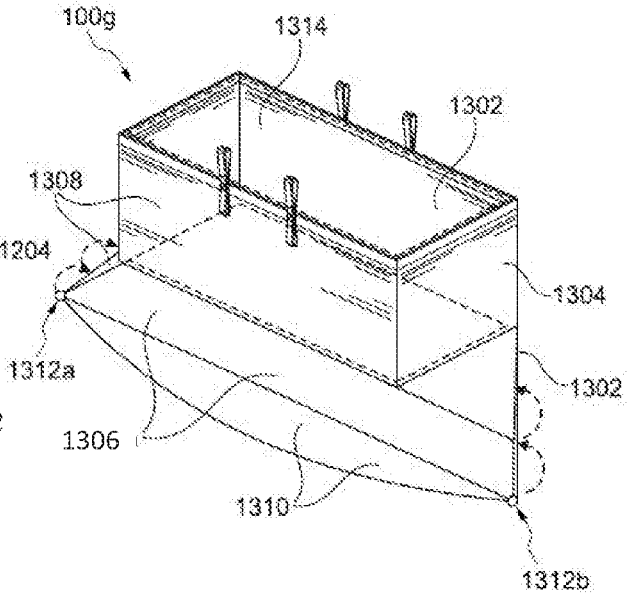
FIG. 13 is a perspective view of a waste disposal bag, according to an embodiment of the present invention.

Referring now to FIG. 13, a perspective view of an alternative embodiment of waste disposal bag 100*g* is shown. According to an embodiment of the present disclosure, waste disposal bag 100*g* is comprised of rear panel 1302, right panel 1304, front panel 1306, and left panel 1308. Rear panel 1302, right panel 1304, front panel 1306, and left panel 1308 may be configured such that an upper portion of each panel is coupled together to define a rectangular open top 1314, and a lower portion of each panel is tapered in shape and coupled together to define an elongated open bottom 1310. A first retaining ring 1312*a* may be disposed on a first end of elongated open bottom 1310 and second retaining ring 1312*b* may be disposed on a second end of elongated open bottom 1310. The lower portion of rear panel 1302, right panel 1304, front panel 1306, and left panel 1308 may be rolled to define a temporary bottom surface of waste disposal bag 100*g*. Retaining ring 1312*a* and retaining ring 1312*b* may be pulled to meet together at an approximate midpoint of waste disposal bag 100*g*, and coupled together using a quick release shackle or other temporary retaining mechanism. A user may expose elongated open bottom 1310 by disengaging the quick release shackle or other temporary retaining mechanism and unrolling the lower portion of rear panel 1302, right panel 1304, front panel 1306, and left panel 1308.

Figure 14:
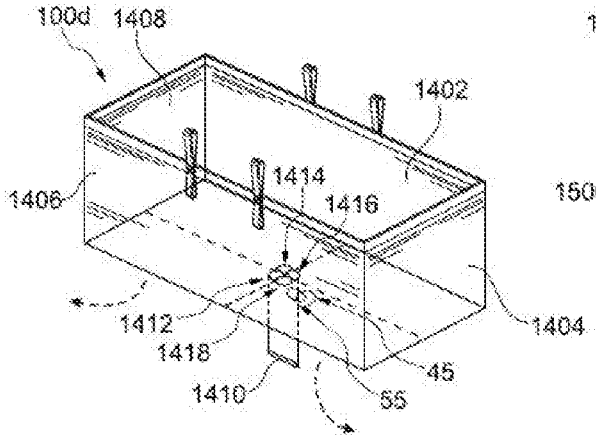
FIG. 14 is a perspective view of a waste disposal bag, according to an embodiment of the present invention; and, FIG. 15 is a perspective view of a waste disposal bag, according to an embodiment of the present invention.

Referring now to FIG. 14, a perspective view of an alternative embodiment of waste disposal bag 100*d* is shown. According to an embodiment of the present disclosure, waste disposal bag 100*d* is comprised of rear panel 1402, right panel 1404, front panel 1406, and left panel 1408. According to an embodiment, rear panel 1402 may include a retaining device 1414, right panel 1404 may include a retaining device 1416, front panel 1406 may include a retaining device 1418, and/or left panel 1408 may include a retaining device 1412. One of the panels, for example right panel 1404, may include a retaining strap 1410. Retaining devices 1412, 1414, 1416, and/or 1418 may comprise a ring, grommet, hook, strap, fastener, and/or some combination thereof. A lower flap of rear panel 1402, right panel 1404, front panel 1406, and left panel 1408 may be folded inward to define a temporary bottom surface of waste disposal bag 100*d*, and each of the retaining rings 1412, 1414, 1416, and/or 1418 may be interfaced with retaining strap 1410 and temporarily secured in place via a quick release shackle 55. Quick release shackle may be disengaged via pull cord 45, thereby releasing retaining devices 1412, 1414, 1416, and/or 1418 from retaining strap 1410 and disconnecting rear panel 1402, right panel 1404, front panel 1406, and left panel 1408 to expose the open bottom of waste disposal bag 100*d*.

Figure 15:
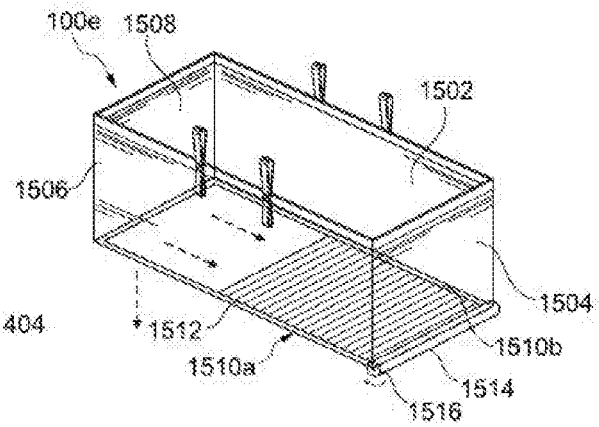

Referring now to FIG. 15, a perspective view of an alternative embodiment of waste disposal bag 100*e* is shown. According to an embodiment of the present disclosure, waste disposal bag 100*e* is comprised of rear panel 1502, right panel 1504, front panel 1506, and left panel 1508. A first track 1510*a* may be disposed along a lower edge of front panel 1506, and a second track 1510*b* may be disposed along a lower edge of rear panel 1502. A roller 1514 with a crank 1516 may be coupled to right panel 1504 or left panel 1508. A retractable surface 1512 may be engaged with roller 1514 and interfaced with track 1510*a* and track 1510*b*. Retractable surface 1512 may be extended to define a temporary bottom surface of waste disposal bag 100*e*, or may be rolled around roller 1514 via crank 1516 to expose an open bottom area of waste disposal bag 100*e*.

The present disclosure includes that contained in the appended claims as well as that of the foregoing description. While embodiments of the present disclosure have been described using an illustrative commercial use case of waste/trash collection and disposal, it is understood that such use case is made for the purpose of illustration to aid in the understanding of the present invention. Embodiments of the present disclosure may be used to collect any assortment of dry contents that a user might wish to collect and retain. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention. Therefore, it will be apparent to those skilled in the art that various modifications and variations can be made to the disclosed embodiments without departing from the scope or spirit of the invention. In view of the foregoing, it is intended that the invention covers modifications and variations of this disclosure within the scope of the following claims and their equivalents.

What is claimed is:

1. A foldable container comprising:

a front panel, a left side panel, a right side panel, and a rear panel, the front panel and the right side panel being partially coupled together along approximately half of a left edge of the right side panel, the rear panel and the right side panel being partially coupled together along approximately half of a right edge of the right side panel, the front panel and the left side panel being partially coupled together along approximately half of a right edge of the left side panel, the rear panel and the left side panel being partially coupled together along approximately half of a left edge of the left side panel, the front panel, the left side panel, the right side panel, and the rear panel being coupled together to define an open top portion and an open bottom portion;

a first connecting strap and a second connecting strap coupled to an upper edge of the front panel, the first connecting strap and the second connecting strap each comprising an upper loop and a lower loop;

a first pair of straps coupled to an outer surface of the rear panel from an upper edge of the rear panel to a lower edge of the rear panel, the first pair of straps being coupled together at a first end to define a loop and being coupled together to overlap at a second end;

a second pair of straps coupled to an outer surface of the rear panel adjacent to the first pair of straps from the upper edge of the rear panel to the lower edge of the rear panel, the second pair of straps being coupled together at a first end to define a loop and being coupled together to overlap at a second end, the rear panel, the first pair of straps, and the second pair of straps being configured to extend across the open bottom portion and around a portion of the front panel to define a bottom surface, the second end of the first pair of straps being configured to extend through the lower loop of the first connecting strap, and the second end of the second pair of straps being configured to extend through the lower loop of the second connecting strap, the second end of the first pair of straps and the second end of the second pair of straps being configured to be removably coupled together.

2. The foldable container of claim 1 further comprising a first grommet disposed on the second end of the first pair of straps, and a second grommet disposed on the second end of the second pair of straps.

3. The foldable container of claim 1 further comprising a first sleeve disposed over the second end of the first pair of straps.

4. The foldable container of claim 1 further comprising a second sleeve disposed over the second end of the first pair of straps.

5. The foldable container of claim 2 further comprising a quick release shackle removably coupled to the first grommet and the second grommet.

6. The foldable container of claim 5 further comprising a pull cord operably coupled to the quick release shackle.

7. The foldable container of claim 1 wherein a lower portion of the right side panel defines a flap configured to extend over an area of the open bottom portion.

8. The foldable container of claim 1 wherein a lower portion of the front panel defines a flap configured to extend over an area of the open bottom portion.

9. The foldable container of claim 1 wherein a lower portion of the left side panel defines a flap configured to extend over an area of the open bottom portion.

10. The foldable container of claim 1 wherein the front panel, the left side panel, the right side panel, and the rear panel are constructed of a polypropylene fabric.

11. The foldable container of claim 1 further comprising one or more poles removably coupled to one or more of the front panel, the left side panel, the right side panel, and the rear panel and extending vertically between the open top portion and the open bottom portion.

* * * * *